US007757966B2

(12) United States Patent
Smith

(10) Patent No.: US 7,757,966 B2
(45) Date of Patent: Jul. 20, 2010

(54) HIGH-SPEED JET CONTROL

(75) Inventor: Barton L. Smith, Logan, UT (US)

(73) Assignee: Utah State University, North Logan, UT (US)

( * ) Notice: Subject to any disclaimer, the term of this patent is extended or adjusted under 35 U.S.C. 154(b) by 364 days.

(21) Appl. No.: 11/637,443

(22) Filed: Dec. 11, 2006

(65) Prior Publication Data

US 2007/0158468 A1 Jul. 12, 2007

Related U.S. Application Data

(60) Provisional application No. 60/749,202, filed on Dec. 9, 2005.

(51) Int. Cl.
*B05B 3/08* (2006.01)
*B05B 3/00* (2006.01)

(52) U.S. Cl. ..... 239/232; 239/231; 239/244; 239/245; 239/247; 239/263.3; 239/264; 239/DIG. 7

(58) Field of Classification Search ..... 239/79, 239/398, 399, 402.5, 403, 405, 406, 408, 239/416.4, 416.5, 420, 421, 423, 424, 432, 239/433, 434.5, 225.1, 231, 232, 233, 244, 239/245, 247, 263.3, 264, DIG. 7
See application file for complete search history.

(56) References Cited

U.S. PATENT DOCUMENTS 3,836,315 A * 9/1974 Shular ..... 431/9
4,475,885 A * 10/1984 Finke ..... 431/182
4,585,177 A * 4/1986 Sugawara et al. ..... 239/590
5,110,285 A * 5/1992 Snyder et al. ..... 431/8
5,658,141 A * 8/1997 Larquet et al. ..... 431/187
5,737,921 A * 4/1998 Jones et al. ..... 60/740

* cited by examiner

*Primary Examiner*—Dinh Q Nguyen
*Assistant Examiner*—Ryan Reis

(57) ABSTRACT

A device is disclosed that uses a flow-control methodology to control sprays at very high precision and frequency. The device is based on an enhanced Coanda effect. The control flow is selectively applied to the region in which we desire the jet to vector and control the profile (width) of the jet. In one embodiment, the control flow is applied at the desired circumferential location by the action of a rotting disk with a flow passage of a size that spreads the jet the desired amount. The size of this flow passage may be controlled by using two overlapping disks with large holes in each. By rotating one disk relative to the other, the size of the resultant passage can be modified.

19 Claims, 16 Drawing Sheets

Schematic of one embodiment of device showing primary flow channel, control channel, control surface and direction control modulator

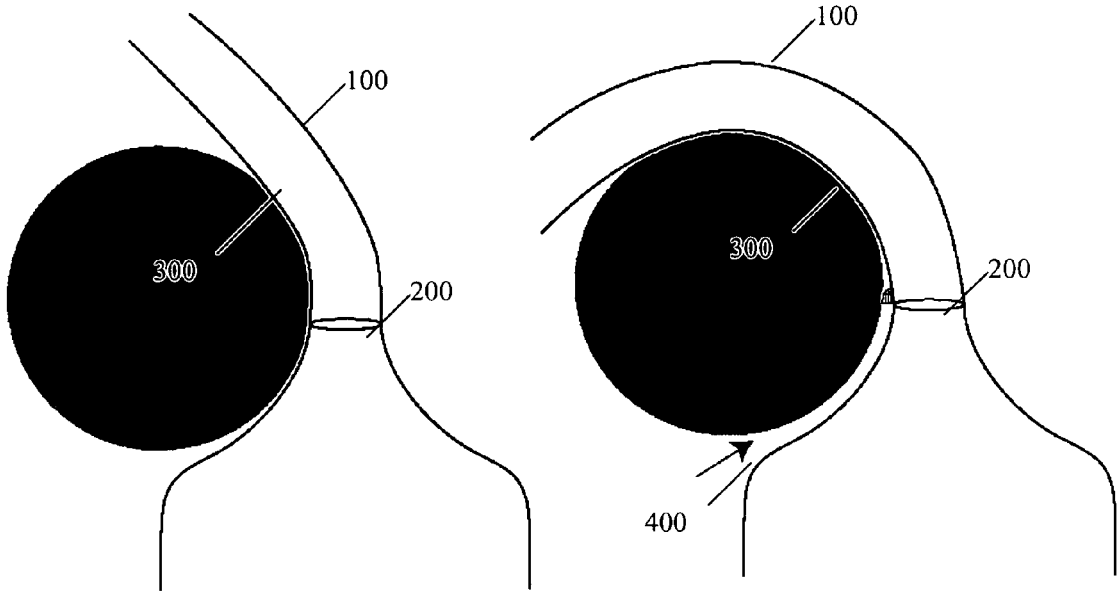
Figure 1. The flow characteristics of the Coanda Effect

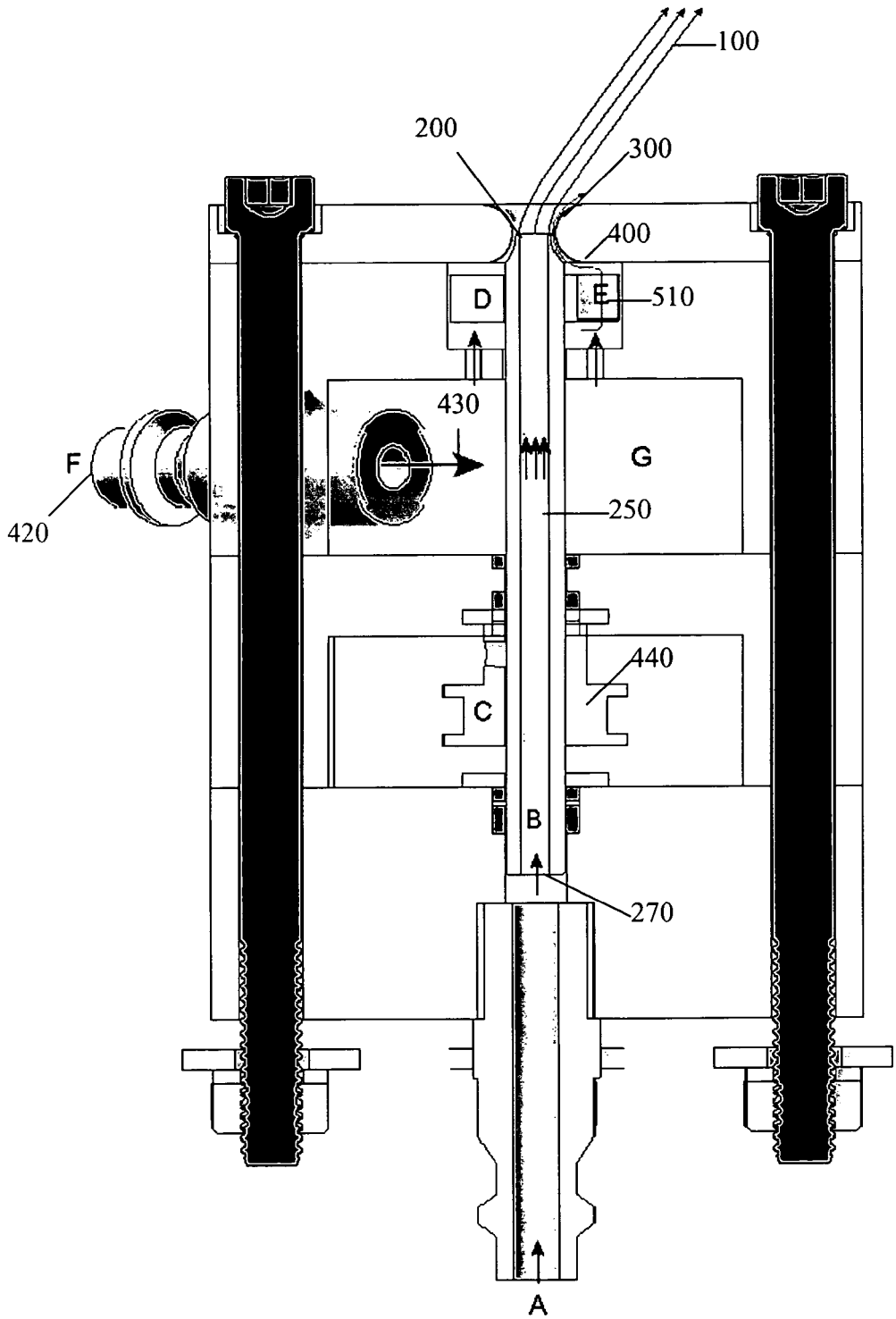
Figure 2. Schematic drawing of a flow vectoring device

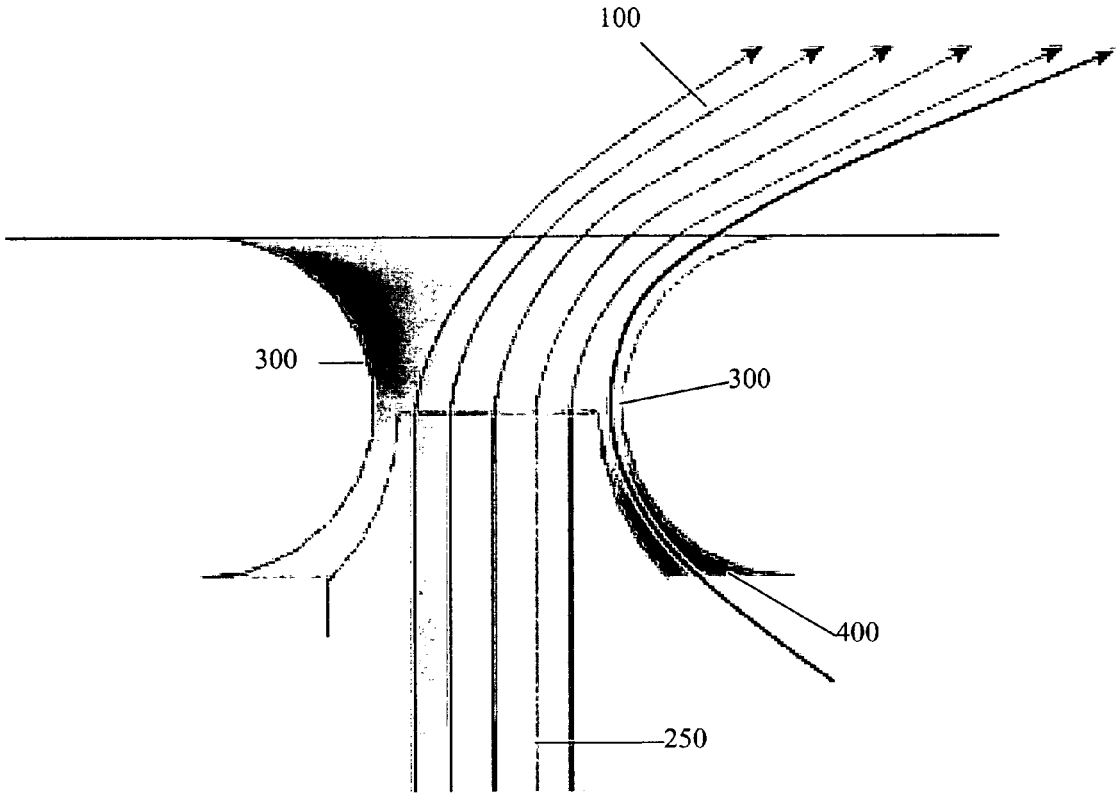
Figure 3: Coanda-Assisted Spray Manipulation nozzle.

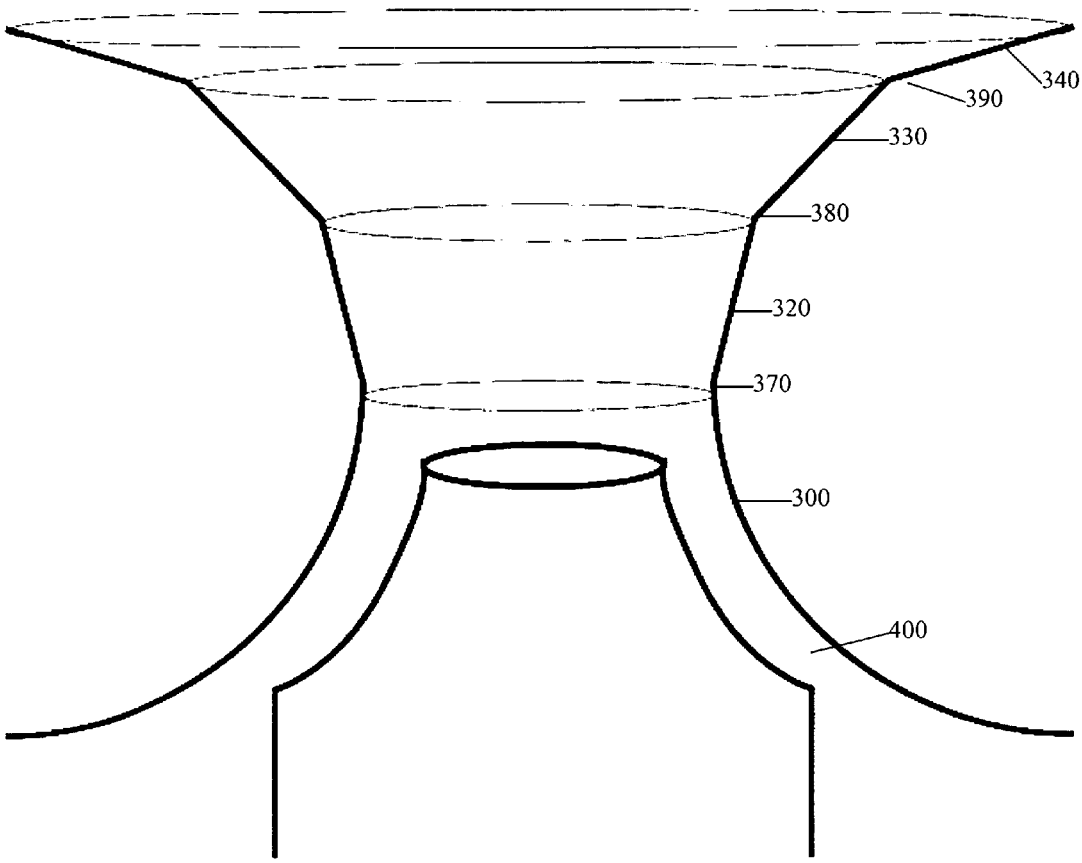
Figure 4: One embodiment of a flow surface fretted nozzle, designed to enhance stability of vectoring angle by providing discrete separation points.

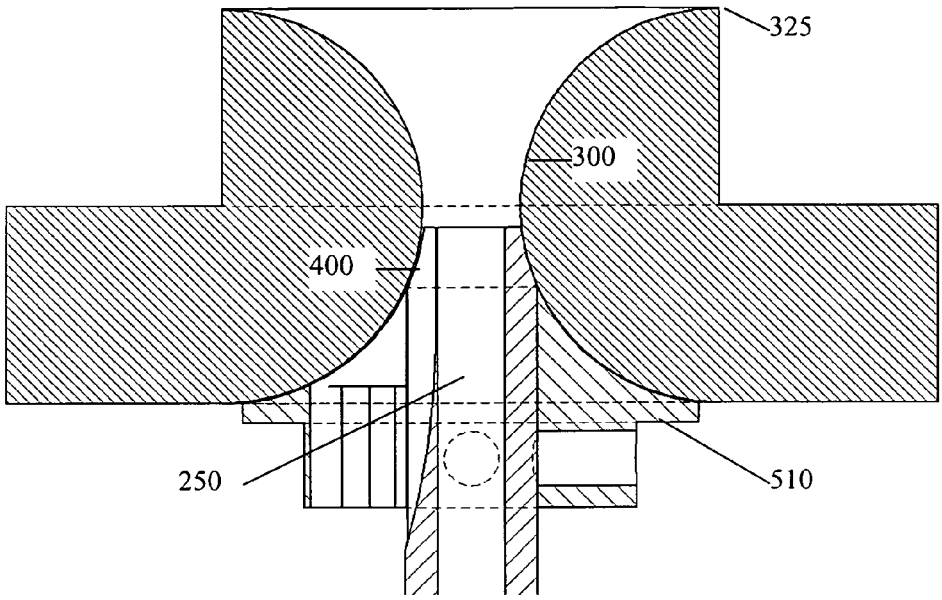
Figure 5. One embodiment of a control flow modulator with a flow control surface with large flow surface discontinuity

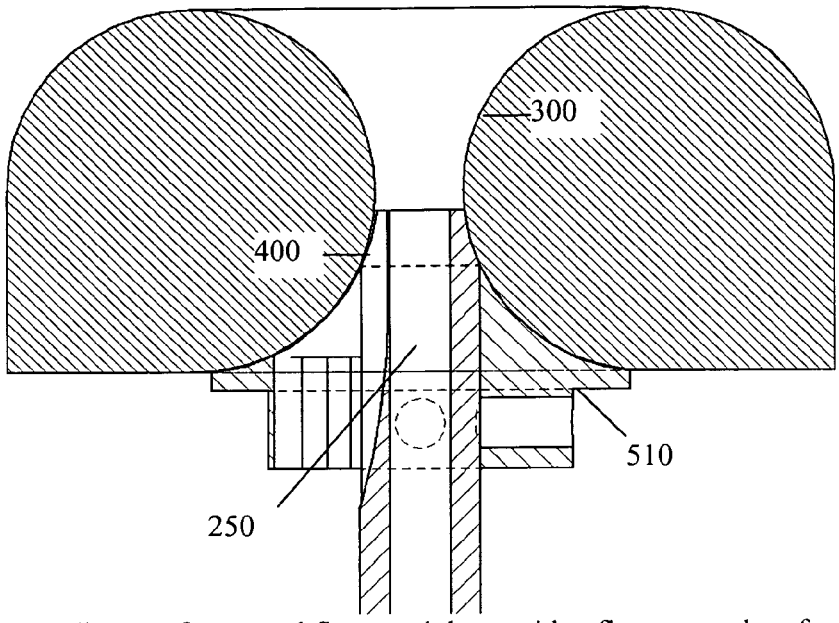
Figure 6. One embodiment of a control flow modulator with a flow control surface with a continuous flow surface

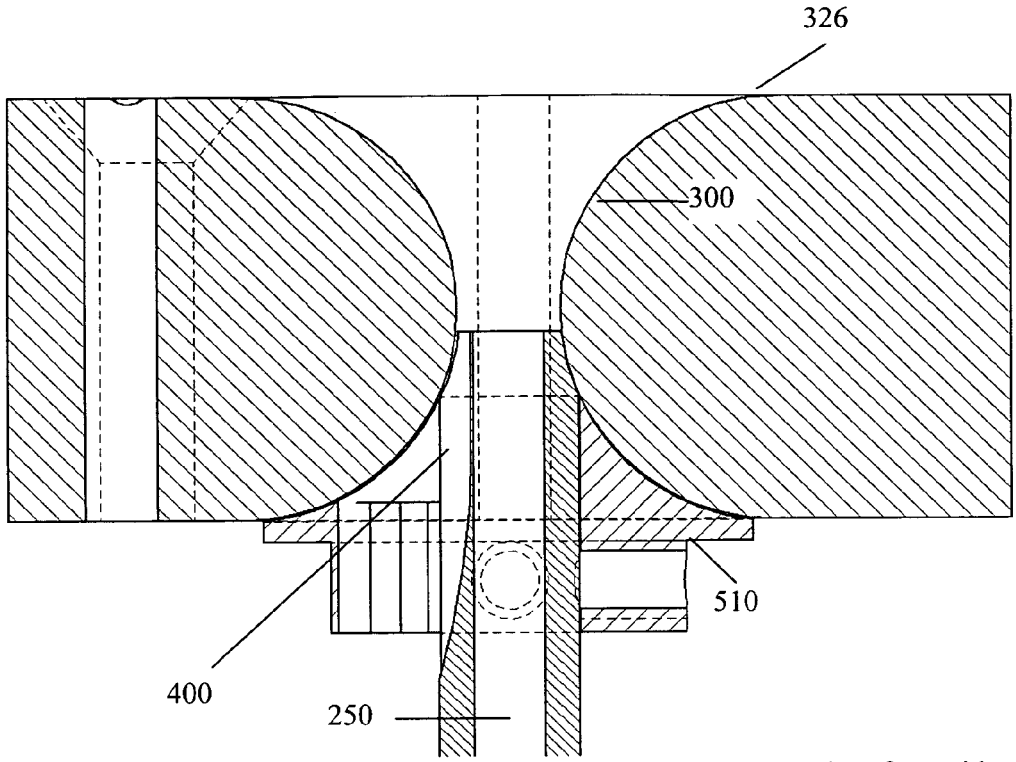
Figure 7. One embodiment of a control flow modulator with a flow control surface with a continuous flow surface to flat region

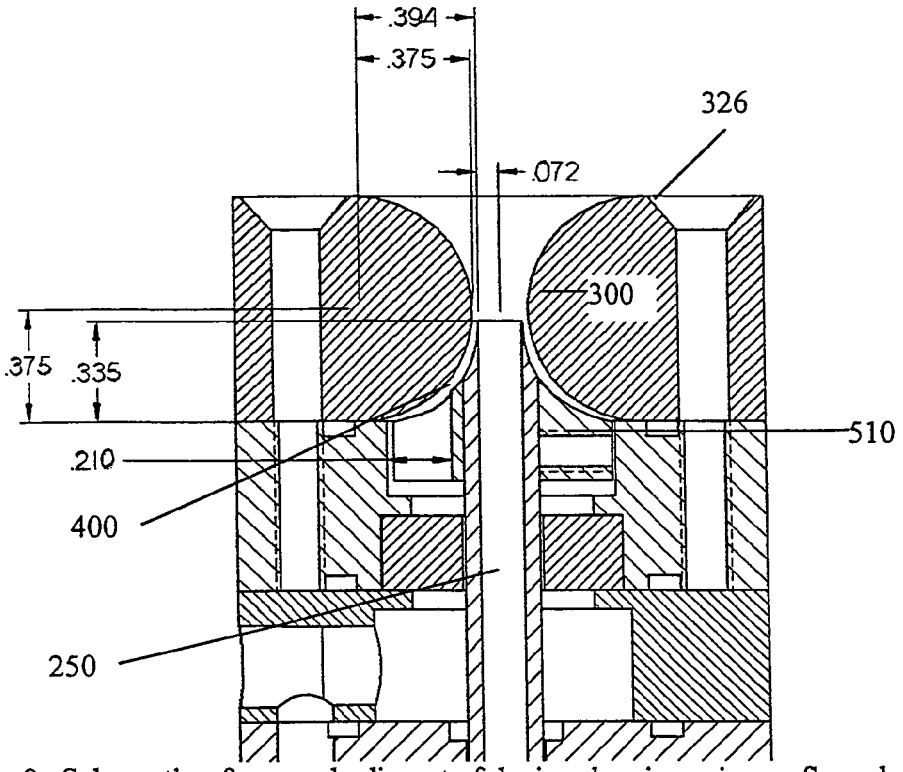
Figure 8. Schematic of one embodiment of device showing primary flow channel, control channel, control surface and direction control modulator

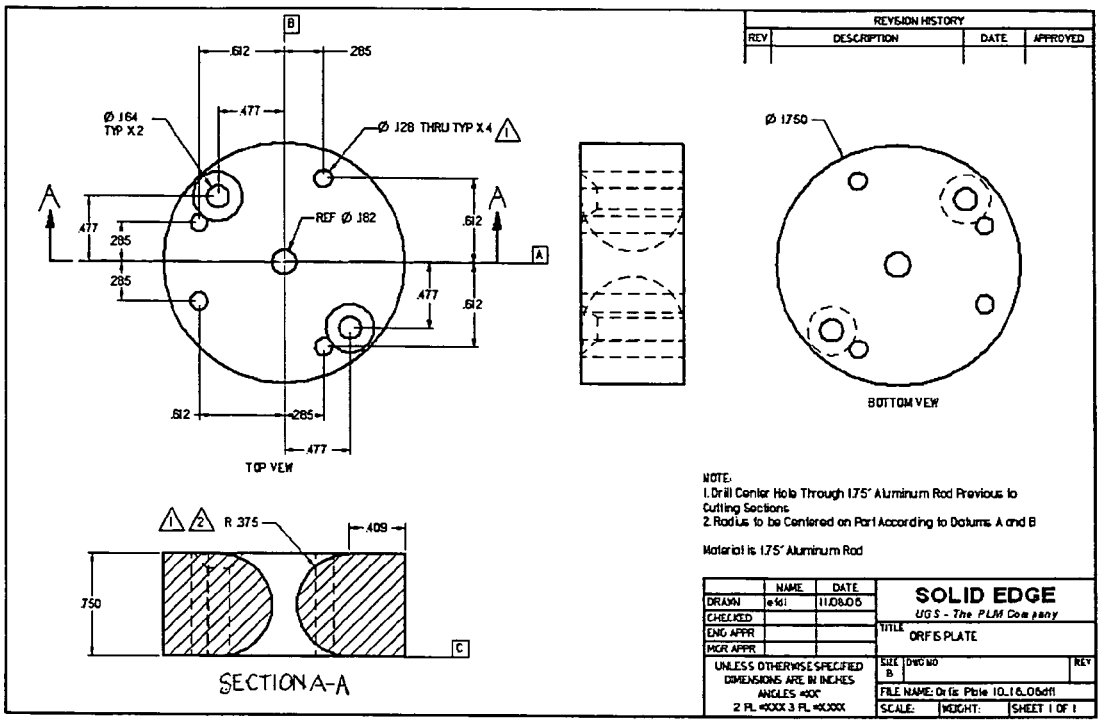
Figure 9. Detail of one embodiment of Orifice Plate

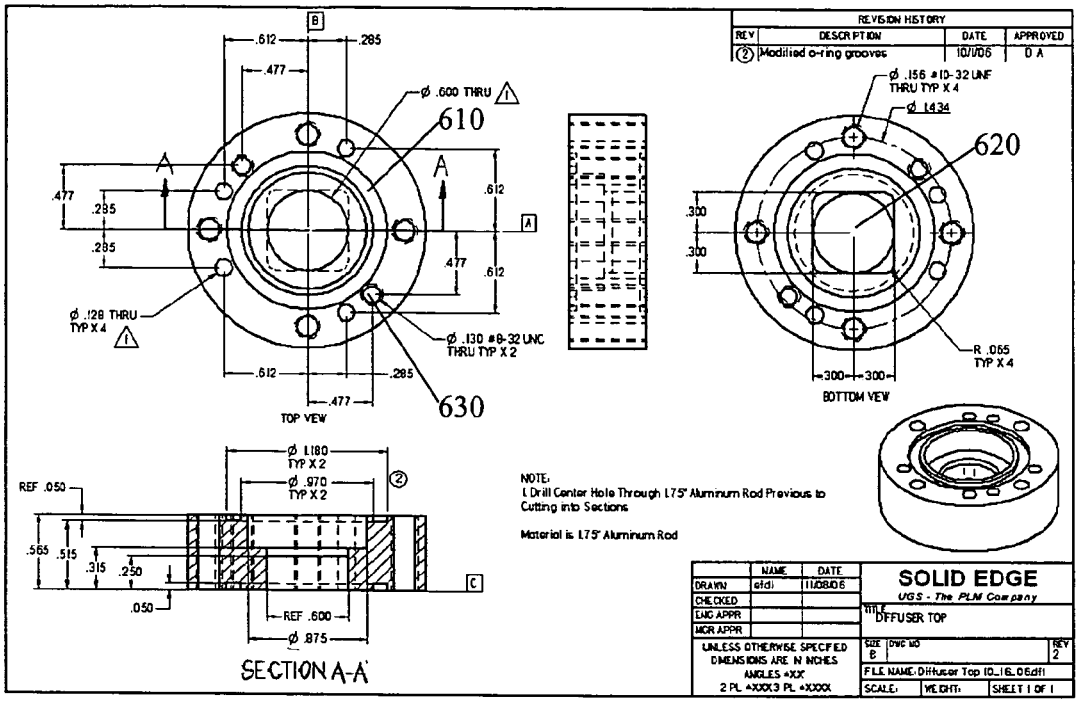
Figure 10. Detail of one embodiment of a Diffuser Top

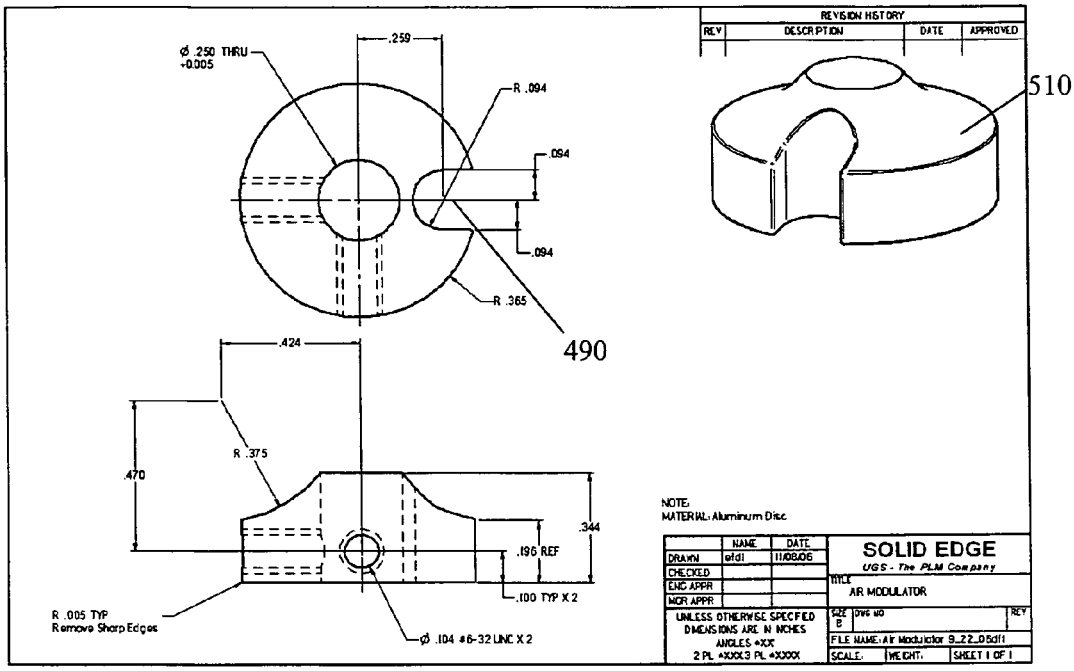
Figure 11. Detail of one embodiment of a control flow modulator

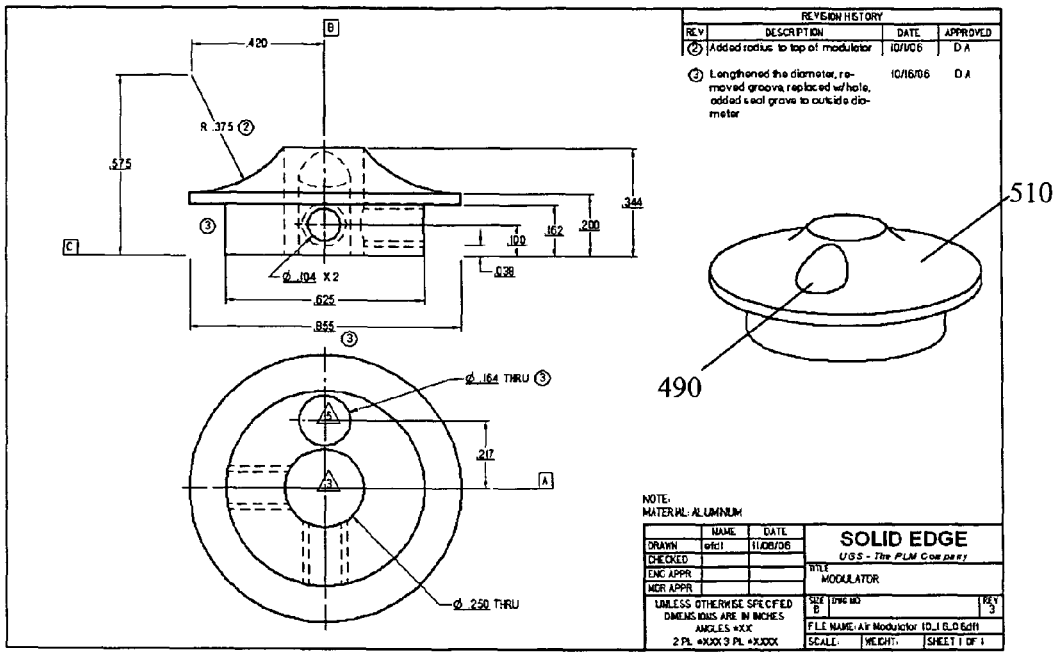
Figure 12. Detail of another embodiment of a control flow modulator

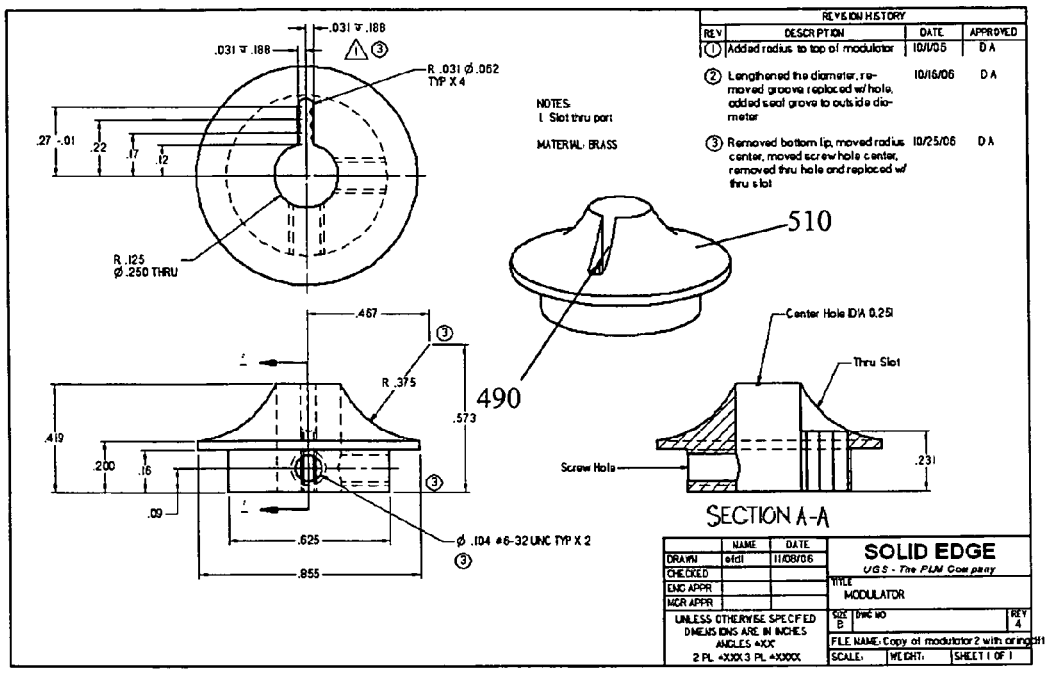
Figure 13. Detail of another embodiment of a control flow modulator

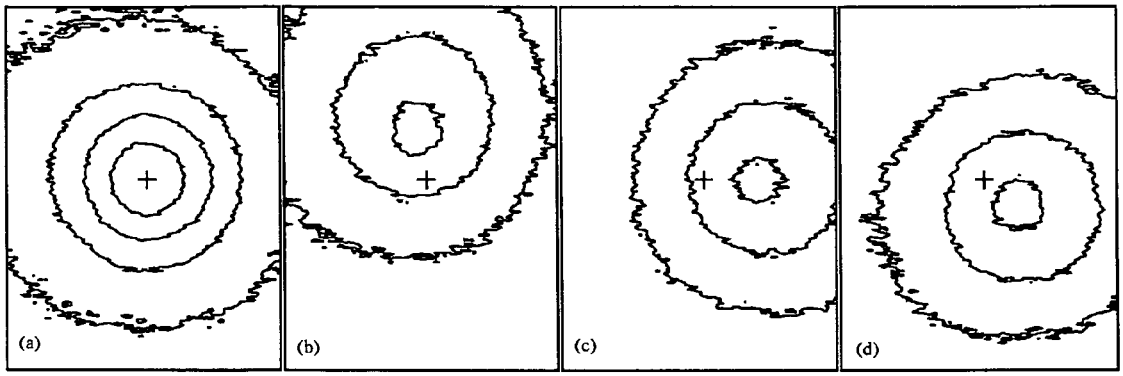
Figure 14: Results from a demonstration of the Coanda–Assisted Spray Manipulation.

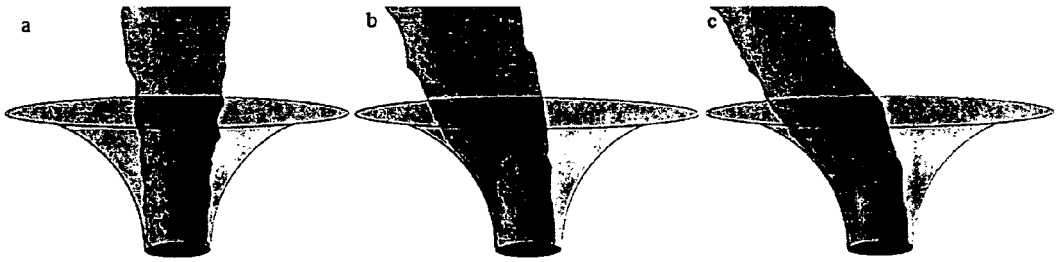
Fig. 15a shows an isocontour of temperature of the heated jet emerging from the rounded collar with no control applied. The addition of a small amount of control flow (a tenth of the primary mass flow) results in a substantial vector angle toward the control slot (Fig. 15b). An increase in the control flow increases the vector angle (Fig. 15c).

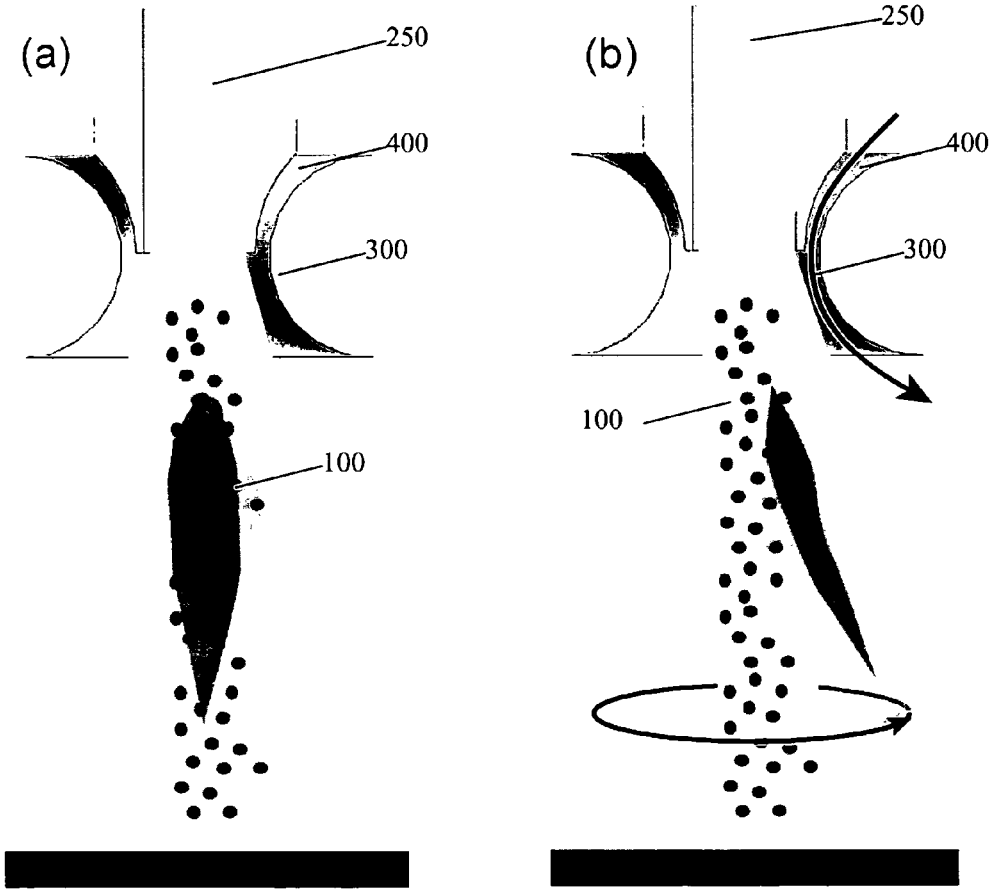
Figure 16. Application example. One can improve a flame spray processes by rapidly orbiting the flame at rates above the response time of the particulate material. (a) Conventional Flame Spray (b) Flame spray with vectoring and orbiting control applied.

HIGH-SPEED JET CONTROL

RELATED APPLICATIONS

This application claims priority to U.S. patent application Ser. No. 60/749,202 filed on Dec. 9, 2005, entitled "High-Speed Jet Control", and is incorporated herein by reference.

TECHNICAL FIELD

This present invention relates to methods and devices for directing and controlling high-speed fluid jets and thermal sprays.

BACKGROUND

There are many processes that can benefit from the ability to precisely vector a jet and to control its width. These include thin-film coating processes in which it is vitally important that the film thickness be uniform, even if the surface to be coated is not flat. In many of these processes, such as Thermal sprays, the contents of the jet or spray are combusting, making the environment in which the jet operates very hostile. Control schemes that rely on vectoring of the jet nozzle would place moving parts in this hostile environment, where they would wear quickly, and be severely limited in slew rate. Multiple nozzles can be used to cover a large area, but they (or the coated surface) must be traversed. Additionally, it is difficult to coat evenly in this manner.

The most fundamental method of changing the direction and shape of a jet is by modifying the direction and shape of the nozzle from which it emanates. The hardware required to effect these changes is unreliable and heavy and thus slow.

More elegant methods include the use of secondary flows to modify the jet. One method is to use oscillatory blowing to vector a planar jet. A high slew rate is one of the primary advantages to this method. However, it is difficult to reliably generate the required oscillatory blowing. Another method uses a combination of blowing and suction through adjacent slots to achieve a similar effect. Suction combined with a Coanda surface has been shown to be effective for vectoring a compressible jet flow. Schemes involving suction prohibit use in hostile environments such as combustion since hot and/or corrosive gas would be drawn into the suction slot.

There is considerable need for a nozzle that can be built over a large range of scales, operate in a hostile environment, and position a jet or aerosol precisely and at high slew rate.

Many industrial spray processes can benefit from precise direction and profile control. Thermal spray processing is an established industrial method for applying "thick coatings" of metals (stainless steel, cast iron, aluminum, titanium and copper alloys, niobium and zirconium) and metal blends, ceramics, polymers, and even bio-materials at thicknesses greater than 50 micrometers. Several different processes, including Combustion Wire Thermal Spray, Combustion Powder Thermal Spray, Arc Wire Thermal Spray, Plasma Thermal Spray, HVOF Thermal Spray, Detonation Thermal Spray, and Cold Spray Coating can benefit from the ability to alter the direction of the spray. Currently, expensive robots are commonly used for this purpose. Thermal spray coatings are used for corrosion and erosion prevention, chemical or thermal barrier and wear protection, and general metalizing on applications ranging from aircraft engines and automotive parts to medical implants and electronics. The process involves spraying molten powder or wire feedstock onto a prepared surface (usually metallic) where impaction and solidification occur. Melting typically occurs through oxy-fuel combustion in the nozzle or an electric arc (plasma spray) located just downstream of the nozzle structure. Thermal spray processes typically result in very high material cooling rates (>106 K/s). Similarly, Flame Spray Pyrolysis (FSP), a process to synthesize metal and mixed metal oxide nanoparticles, uses a flame as an energy source to produce intraparticle chemical reactions and convert liquid sprayed reagents to the final product. Due to the high temperature combustion environment present in or near these process nozzles, mechanical vectoring of the nozzle is not feasible since this would place moving parts in the jet flow, reduce device durability, and severely limit directional frequency response. Furthermore, traversing a part to be coated, which is often heated to high temperatures, is costly.

Films are deposited on surfaces (substrate) using a variety of thermal spay processes, depending on the material to be deposited and the surface on which it is to be applied. The processes generally belong to one of three categories: flame spray, electric arc spray, and plasma arc spray. The nozzles of modern thermal spray devices are designed to create the desired process and are generally not directional. Coating of large surfaces is achieved by traversing the spray gun, sometimes with a dedicated robot.

In many flame processes, as little as 10% of the flame energy is used to melt the feedstock. This results in excessive heating of the substrate. The time that the coating material resides in the flame, termed residence time, is critical to many characteristics of the coating, including porosity and oxidation. Porosity of the coating is very important and is a function of many parameters of the process, including particle speed, size distribution and spray distance. Molten material that is not sufficiently heated may result in higher porosity, as can sprays applied at a large angle relative to the surface. In many applications, it is desirable to have low porosity, while in others, higher porosity may be beneficial (e.g. tribological applications and biomedical implants). Thus, a robust and simple method to control porosity is beneficial.

One method of changing the direction and shape of a jet is by modifying the direction and shape of the nozzle from which it flows. This is currently being investigated as a method for thrust-vectoring of fighter aircraft, although the hardware required to effect these changes is unreliable and heavy (and thus slow). More elegant methods include the use of secondary flows to modify the jet. High frequency response is one of the primary advantages of this method. However, it is difficult to reliably generate the required oscillatory blowing. Suction combined with a Coanda surface has been shown to be effective for vectoring a compressible jet flow. Unfortunately, schemes involving suction prohibit use in hostile environments such as combustion since hot and/or corrosive gas would be drawn into the suction slot.

SUMMARY OF THE INVENTION

A new device is disclosed that uses a flow-control methodology to control the direction and profile of high-speed jets or sprays at very high precision and frequency. The device is based on an enhanced Coanda effect. The device will make it possible to control flow in harsh environments and to apply thin films to very large surface areas with a single nozzle, and to do so to a precisely desired thickness.

This device makes use of an enhanced Coanda effect, termed Coanda assisted Spray Manipulation (CSM), to vector and control the profile (width) of the jet. The Coanda effect, or the tendency of jets to adhere to nearby surfaces, is a well established flow-control methodology. Flow-control is achieved by adding a blowing control flow to enhance profile and direction control and improve the stability of the jet or spray. This device makes it possible to apply films on large surfaces at precisely controllable thicknesses with a single nozzle and no moving parts in or near the jet flow (where corrosive materials, combustion and/or high temperatures may be present). As such, the new device will enable long-term operation of controllable jets or sprays in harsh, corrosive, and combusting environments.

The primary jet flow is supplied through a supply line from the bottom of the device. The fluid then enters the jet conduit which is free to rotate relative to the rest of the device. The conduit is rotated by a timing gear part way up the conduit. A disk with one small passage is set onto the conduit near the exit and spins with the shaft (in fact, the conduit spins in order to spin this disk). The blowing control flow is introduced into the side of the device from a second, independent high-pressure source. The control flow enters a plenum, moves through a pressure drop to even out the flow through the disk passage and flows out the nozzle. The jet then vectors toward the control flow at an angle that increases with the speed of the control flow.

CSM can improve flame spray processes by rapidly orbiting the flame at rates above the response time of the particulate material. By orbiting the flame, the intense heating of the substrate that is typical of flame sprays is mitigated. The heat is spread to a much larger area resulting in lower temperatures.

DESCRIPTION OF THE FIGURES

FIG. 1. The flow characteristics of the Coanda Effect

FIG. 2. Schematic drawing of a flow vectoring device

FIG. 3: Coanda-assisted Spray Manipulation nozzle.

FIG. 4: One embodiment of a flow surface fretted nozzle, designed to enhance stability of vectoring angle by providing discrete separation points.

FIG. 5. One embodiment of a control flow modulator with a flow control surface with large flow surface discontinuity FIG. 6. One embodiment of a control flow modulator with a flow control surface with a continuous flow surface FIG. 7. One embodiment of a control flow modulator with a flow control surface with a continuous flow surface to flat region FIG. 8. Schematic of one embodiment of device showing primary flow channel, control channel, control surface and direction control modulator FIG. 9. Detail of one embodiment of Orifice Plate FIG. 10. Detail of one embodiment of a Diffuser Top FIG. 11. Detail of one embodiment of a control flow modulator FIG. 12. Detail of another embodiment of a control flow modulator FIG. 13. Detail of another embodiment of a control flow modulator FIG. 14: Results from a demonstration of the Coanda-Assisted Spray Manipulation.

FIG. 15*a* shows an isocontour of temperature of the heated jet emerging from the rounded collar with no control applied. The addition of a small amount of control flow (a tenth of the primary mass flow) results in a substantial vector angle toward the control slot (FIG. 15*b*). An increase in the control flow increases the vector angle (FIG. 15*c*).

FIG. 16. Application example. One can improve a flame spray processes by rapidly orbiting the flame at rates above the response time of the particulate material. (a) Conventional Flame Spray (b) Flame spray with vectoring and orbiting control applied.

DETAILED DESCRIPTION OF THE INVENTION

This disclosure presents a new device that uses a flow-control methodology to control sprays at very high precision and frequency. The device has several applications, for example it will make it possible to apply thin films to very large surface areas with a single nozzle, and to the so to a precisely desired thickness.

The Coanda effect, also known as "boundary-layer attachment", is the tendency of a stream of fluid 100 to stay attached to a convex surface 300, rather than follow a straight line in its original direction. The principle was named after Romanian inventor Henri Coandă, who was the first to understand the practical importance of the phenomenon for aircraft development. The Coanda effect results form the reduced pressure on the inside of the turning radius. This competes with the dissipation of the boundary-layer energy until the flow detaches from the surface. The jet is simply turned and nominally retains the same cross-section dimension. The Coanda effect is often bi-stable, meaning the flow may be completely attached or completely separated depending on the initial conditions, or even unstable, resulting in undesirable flapping of the flow.

Boundary-layer separation, such as the separation of the jet for the surface, is often suppressed by blowing through a slot 400 in line with the flow. By applying blowing in the region where the jet meets the surface 400, the Coanda effect can be controlled and/or enhanced. By adding blowing, it is also possible to turn the jet over a much smaller radius than without blowing. By changing the speed of the blowing flow, the angle to which the jet is "vectored" can then be controlled.

Coanda-assisted Spray Manipulation (a term we use to refer to Coanda enhanced with blowing control flow) offers the advantages of high-reliability, high-directional frequency response, and usefulness in hostile environments since there is no suction flow or moving parts in the jet flow. It is known by those skilled in the art that the spray nozzle exit radius needs to be large enough to allow vectoring up to a maximum of 90° since, generally, larger vectoring angles can be achieved with less control flow if the exit radius is larger. If the radius is too large, however, excessive space is required and the jet may vector spontaneously in the absence of blowing control flow.

If the Coanda surfaces surround the jet, it is also possible to expand the jet flow. An axisymmetric jet with a thin, annular control flow applied in line with the jet can cause the jet flow to attach to the exit plane in every circumferential direction, resulting in an extreme expansion of the jet flow.

We disclose a device with a geometry where the control flow is selectively applied to the region in which we desire the jet to turn rather than a control flow applied uniformly across the circumference of the control slot. Furthermore, the jet will be expanded as desired by applying the control flow to a substantial portion of the circumference. In one embodiment, the control flow 400 is applied at the desired circumferential location by the action of a rotating modulator disk 510 with a flow passage sized to spread the jet the desired amount. The modulator disk 510 serves to position the application of the control flow to the desired circumferential location. It may also control the distribution of the control flow (for example; more in some places, less in others) for the purpose of controlling the jet profile. One embodiment of the device is shown in FIG. 2. The size of the flow passage may be controlled by using two overlapping disks with large holes in each. By rotating one disk relative to the other, the size of the resultant passage can be modified. The control flow may be positioned rapidly to a new circumferential location by the action of a rotating disk with a flow passage sized to spread the jet the desired amount. The angle of the vectoring is controlled by the speed of the control flow while the circumferential location is controlled by the location of the flow passage in the disk.

The primary flow 100, the flow that is to be directed and utilized in a particular application, is fed through a fluid passage 250 (channel). The control flow flows through a second passage 400 (channel). The control flow 400 interacts with the primary flow 100 near the exit of the apparatus. The control flow is blown adjacent to a surface 300 at the exit of the apparatus. The control flow 400 follows the surface 300 due to Coanda effect and the primary flow 100 follows the control flow.

The change in direction of the control flow induces the primary flow to also follow the same pattern as the control flow. The surface contour acts to define how the control flow is going to pull the primary flow. In addition to the contour of the control surface, to control the details of the direction and profile of the resulting fluid jet, the operator may control the degree of blowing velocity and amount of material passing through the control flow and the degree of flow velocity and amount of material passing through the primary, The primary jet flow is supplied through an inlet 270 from the bottom of the device. The fluid then enters the jet conduit 250, which is free to rotate relative to the rest of the device. The conduit is rotated by a timing gear 440 part way up the conduit 250. A disk 510 with one small passage creates a control flow channel 400 that is set onto the conduit 250 near the exit and spins with the shaft (in fact, the conduit spins in order to spin this disk), modulating flow in the control flow channel 400. The control flow is introduced into the side of the device from an independent source 420 providing control of the flow in the control flow channel 400. The control flow enters a plenum 430, moves through a pressure drop through the disk passage 510 and moves out the nozzle, merging with the primary jet flow 100. The jet then vectors toward the control flow at an angle that increases with the speed of the control flow.

Rather than a single disk with a single passage, the flow could also be controlled by having two disks slotted over part of their circumference that can be rotated relative to each other. The size of the passage could then be controlled by changing the extent to which the slots in the two disks overlap. A larger passage would result in a wider jet profile.

A third setup would use a single disk mounted eccentrically. By controlling the extent of the eccentricity, the flow could be varied from uniform to concentrated toward one side. Other embodiments of control flow modulators are shown in FIGS. 11-13.

Additional methods to control the delivery location and intensity of a fluid flow are known by those skilled in the art and are equivalents to the flow control methods described. The above descriptions of flow control methods, including preferred embodiments, are to be construed as merely illustrative and not a limitation of the scope of the present invention in any way. It will be obvious to those having skill in the art that many changes may be made to the details of the above-described embodiments without departing from the underlying principles of the invention. It will be appreciated that the methods mentioned or discussed herein are merely examples of means for performing flow control and it should be appreciated that any means for performing flow control which performs functions the same as, or equivalent to, those disclosed herein are intended to fall within the scope of a means for flow control, including those means or methods for flow control which may become available in the future. Anything which functions the same as, or equivalently to, a means for flow control falls within the scope of this element.

The contour, including discontinuities 325, 236, 370,380, 390, of the Coanda control surface 300 that the control flow 400 is flowing over, coupled with the intensity of the control blowing, are used to control the directionality and profile of the outgoing fluid jet. The specific contours of the control surface can be tailored to meet the specific requirements of each different application. In addition to the contours of the control surface, one can control the velocity of the primary, velocity of the control, the amount of fluid jet passing in the control channel and the amount of fluid jet passing in the primary channel.

The primary and the control can contain different fluids that are mixed in the process of combining at the outputs of the channels. This can have the advantage of having the materials mixed directly at the point of delivery. The fluids can contain fuel and oxidizer for a flame to provide heat at the point of delivery. They can also contain two components that result in a useful chemical reaction required in the spray delivery application. Many useful combinations will be evident to those skilled in the art. It will be obvious to those having skill in the art that many changes may be made to the details of the above-described embodiments without departing from the underlying principles of the invention. It will be appreciated that the methods mentioned or discussed herein are merely examples of means for utilizing the combinatorial aspect of the two fluid flows. It should be appreciated that any means for utilizing the combinatorial aspect of the two fluid flows which performs functions the same as, or equivalent to, those disclosed herein are intended to fall within the scope of a means for utilizing the combinatorial aspect of the two fluid flows, including those means or methods for utilizing the combinatorial aspect of the two fluid flows which may become available in the future. Anything which functions the same as, or equivalently to, a means for utilizing the combinatorial aspect of the two fluid flows falls within the scope of this element.

The Coanda effect causes a jet to follow a curved surface and results from the reduced pressure on the inside of the turning radius. The reduced pressure effect competes with the dissipation of boundary-layer energy until the flow ultimately detaches from the surface. As the jet is turned, it nominally retains the same cross-stream dimension, or "profile". While potentially useful, the Coanda effect is often bistable (meaning the flow may be completely attached or completely separated depending on initial conditions) or even unstable, often resulting in an undesirable flapping of the flow. Due to Coanda-like effects, the flow through a rounded exit may expand considerably before detaching if the Reynolds number ($Re=UD/\nu$, where U is the average exit velocity, D is the jet conduit diameter and $\nu$ is the kinematic viscosity of the fluid) is sufficiently large (greater than about 5000). Boundary layer separation, such as the separation of a jet from a Coanda surface, is often controlled or suppressed by blowing through a slot in line with the flow. By applying blowing in the region where the jet meets the turning surface, the Coanda effect can be controlled and/or enhanced. Additionally, it is possible to turn the jet over a much smaller radius with blowing.

The direction can be controlled by the surface 300 adjacent to the control flow 400 that it flows over. That surface 300 can be curved or that surface can have a sudden discontinuity going from curved to a flat region 325, 326. Transition from a curved to flat region can be with a small flow surface discontinuity 326 to modulate the profile of the flow stream or it can have a sharp angle 325 to detach the control from that surface and direct where it should go. The control surface can have flow surface frets 370, 380, 390, sections with a discontinuity that would or would not allow the Coanda flow to stay attached depending on the degree of blowing in the control flow. Where the control flow adheres to the surface will depend on the blowing velocity and amount of material of the control flow and could be further controlled by adjusting the blowing velocity and amount of material of the primary flow. The control surface can be configured with flow surface frets 370, 380, 390 so that the Coanda retention to the surface could be changed at the flow surface fret by adjusting the blowing velocity of the control flow. Under one condition the Coanda blowing would continue to adhere to the control surface after the flow surface fret discontinuity and in another condition the Coanda blowing would detach from the control surface at the flow surface fret discontinuity. This attachment and detachment can be controlled during operation by adjusting the degree of control blowing accordingly. Different flow surface frets 370, 380, 390 can have different discontinuities so that adjustment could be made for adherence or separation from a range of flow surface frets 370, 380, 390 useful to a particular operation.

Profile widening can be enhanced by the addition of blowing through an annular slot around the expansion. An axisymmetric jet with a thin, annular control flow applied in line with the jet can cause the jet flow to attach to the exit plane in every circumferential direction resulting in what may be termed an extreme expansion of the jet flow. However, enhanced Coanda blowing can result in a more practical result—to direct the jet at any desired angle by applying a small amount of control flow at one circumferential position. Enhancing the Coanda effect with blowing is an effective way to thrust vector planar jets. For example, blowing applied on one side will cause the jet to vector toward that side.

Furthermore, it is known that the effectiveness of the control flow is primarily a function of its velocity rather than its flow rate. For this reason, it is desirable to minimize the annular gap that forms the control slot. The size of this gap is limited by the accuracy of the manufacturing methods employed to build the device. For standard machine tools, such as those used to construct the demonstration model shown in FIG. 2, typical tolerances are 0.001 inches, meaning that the velocity in a 0.01-inch gap could vary up to 10%. Such variation would bias the vectoring to one side.

The control flow 400 will not be applied uniformly along the circumference of the control slot, but will instead be applied to the circumferential region in which we desire the jet to turn. Furthermore, the jet or spray will be expanded as desired by applying the control flow to a substantial portion of the circumference. The control flow will be positioned rapidly to a new location by the action of the rotating disk 510 with a flow passage 490 sized to spread the jet the desired amount. This disk 510 and rotating shaft are not located in the jet flow. The vector angle is controlled by the velocity of the control flow and the circumferential blowing location is controlled by the location of the flow passage 490 in the disk. Because the blowing location is controlled by the action of the rotating shaft and not fluidics, high frequency response in the θ direction is achievable.

One important aspect to control is the tendency of the jet under the influence of the control flow "attaching" to the exit plane, thus eliminating the possibility of attaining a range of vectoring angles somewhat less than 90°. We offer a solution to this problem by introducing a flow surface discontinuity 325 where the exit plane beyond the full turning radius has been eliminated.

The modulators shown in FIGS. 5-8 fit tight against the orifice place. A small channel 400 is machined in one circumferential position. The control flow moves though this channel 400. This arrangement eliminates the possibility of the control flow redistributing itself circumferentially before interacting with the primary jet. FIG. 9 shows one embodiment of an orifice plate. This is bolted onto the diffuser plate shown in FIG. 10. This plate incorporates slots 610 for o-ring seals and a cavity 620 for flow straightening material. Several holes 630 around the perimeter accept dowel pins to aid in alignment.

In one embodiment, the primary jet flows at 250 m/s without any control flow. Although this is clearly a compressible flow (M=0.806), we find in both experiments and the numerical simulations described below that compressible effects are not important. The field of view is 7.8×6 inches. The cross hair marks the location of the primary jet nozzle and, without control flow, the jet is centered on this location. The control flow is engaged with the control flow positioned above the primary jet. As a result, the jet spreads somewhat and is vectored upward. The spreading is evident in the increased distance between temperature contours.

In FIG. 4*c*, the disk is rotated, changing θ by 90°. The jet similarly rotates 90°. An additional eighth of a turn of the disk results in a similar circumferential displacement (FIG. 4*d*). Based on the displacement in FIG. 4*b*, the vector angle relative to the streamwise axis is θ=26°. A larger exit radius or smaller slot size will result in larger maximum vector angles. While this was a jet, not a spray or aerosol, particulate of sufficiently small size will follow the jet. In some cases, it may be desirable that the particles do not follow the flow, since this will allow the flame spray processes to be removed from the substrate while the particles continue to impinge on the surface.

The device was found to work over a broad range of velocities with the results depending primarily on the ratio of the primary to control jet velocity. An incompressible 3-D Computational Fluid Dynamics (CFD) simulation of CSM using the commercial code FLUENT was completed to demonstrate the ability to control the vector angle (and thus r on the surface to be coated). FIG. 5*a* shows an isocontour of velocity magnitude of the jet emerging from the rounded collar with no control applied. The addition of a small amount of control flow (a tenth of the primary mass flow) results in a substantial vector angle toward the control slot (FIG. 5*b*). An increase in the control flow increases the vector angle (FIG. 5*c*).

Demonstration Parameters

| | |
|---|---|
| Control Flow: | Velocity = 5.1796 m/s<br>Re = 3380 |
| Primary Flow: | Velocity = 23.793 m/s<br>Re = 5320 |
| Velocity Ratio | 5.1796/23.793 = 0.218 |
| Volumetric Flow Ratio: | 1.333 E−4/2.5 E−4 = 0.533 |

The heated jet impinges on a metal surface. A thermal camera views the surface from the opposite side and contours of temperature are shown. (a) Jet with no control. (b) Control flow applied through passage at θ=0°, (c) control flow at θ=90°, and (d) θ=135°.

The above description fully discloses the invention including preferred embodiments thereof. The examples and embodiments disclosed herein are to be construed as merely illustrative and not a limitation of the scope of the present invention in any way. It will be obvious to those having skill in the art that many changes may be made to the details of the above-described embodiments without departing from the underlying principles of the invention.

What is claimed is:

1. A directionally adjustable spray device comprising:

a fluid flow channel within a housing having an input end and an output end;

a first fluid jet flowing through said flow channel;

a control flow channel circumferentially surrounding said fluid flow channel and having an input end and an output end;

a control flow modulator located within said control flow channel that confines flow through a single circumferential region that is less than half of the total circumference of said control flow channel and blocks flow through the remaining circumferential portion of said control flow channel;

a second fluid jet flowing through said control channel confined to said circumferential region defined by said control flow modulator;

said output end of said control channel and said output end of flow channel merging;

a surface adjacent to said output end of said control flow channel; and said second fluid jet adhering to said surface adjacent to said output end of said control flow channel past the position of said merging.

2. The directionally adjustable spray device of claim 1 further comprising:

a means to rotate said control flow modulator in said control flow channel.

3. A directionally adjustable spray device comprising:

a housing having an input end and an output end;

a fluid flow channel within said housing having an input end and an output end and an axis of symmetry through the center of said fluid flow channel extending in the direction from said input end to said output end such that said fluid flow channel is axial symmetric;

a first fluid jet flowing through said flow channel in the direction of said axis;

a control flow channel circumferentially surrounding said fluid flow channel and having an input end and an output end;

a control flow modulator located within said control flow channel that confines flow through a single circumferential region that is less than half of the total circumference of said control flow channel and blocks flow through the remaining circumferential portion of said control flow channel;

a second fluid jet flowing through said control channel confined to said circumferential region defined by said control flow modulator;

said output end of said control channel and said output end of flow channel merging close to said output end of said housing;

a surface adjacent to said output end of said control flow channel; and said second fluid jet adhering at a circumferential position corresponding to said control flow modulator to said surface adjacent to said output end of said control flow channel past the position of said merging such that the direction of said first fluid jet is vectored off axis toward said second fluid jet upon exiting from said fluid flow channel.

4. The directionally adjustable spray device of claim 3 further comprising:

a means to rotate said control flow modulator in said control flow channel.

5. The directionally adjustable spray device of claim 3 further comprising:

a conical frustum-like shaped surface adjacent to said output end of said control flow channel.

6. The directionally adjustable spray device of claim 5 wherein:

said conical frustum-like shaped surface adjacent to said output end of said control flow channel is a continuous curved surface.

7. The directionally adjustable spray device of claim 5 wherein:

said conical frustum-like shaped surface adjacent to said output end of said control flow channel is a continuous curved surface that also includes an essentially flat section of surface.

8. The directionally adjustable spray device of claim 5 wherein:

said conical frustum-like shaped surface adjacent to said output end of said control flow channel is a continuous surface that includes a flow surface discontinuity.

9. The directionally adjustable spray device of claim 5 wherein:

said conical frustum-like shaped surface adjacent to said output end of said control flow channel is a continuous surface that includes flow surface frets.

10. A directionally adjustable spray device comprising:

a housing having an input end and an output end;

a fluid flow channel within said housing having an input end and an output end and an axis of symmetry through the center of said fluid flow channel extending in the direction from said input end to said output end such that said fluid flow channel is axial symmetric;

a first fluid jet flowing through said flow channel in the direction of said axis;

a control flow channel having an input end and an output end;

a control flow modulator located within said control flow channel;

a second fluid jet flowing through said control channel and said control flow modulator;

said control flow channel surrounding said fluid flow channel;

said control flow modulator is adjustable to limit the flow through said control flow channel to a circumferential portion of said control flow channel defined by an arc with an angle of 180 degrees or less;

said output end of said control channel and said output end of flow channel merging close to said output end of said housing;

said control flow modulator can be rotated to provide a means to control the circumferential position of said control flow in said control flow channel, a surface adjacent to said output end of said control flow channel;

said second fluid jet adhering at a circumferential position corresponding to said control flow modulator to said surface adjacent to said output end of said control flow channel past the position of said merging, such that the direction of said first fluid jet is turned toward said second fluid jet upon exiting from said fluid flow channel.

11. The directionally adjustable spray device of claim 10 wherein:

said control flow modulator is a rotatable device with a slotted fluid flow passage.

12. The directionally adjustable spray device of claim 10 wherein:

said control flow modulator has two rotatable devices each with a slotted fluid flow passage.

13. The directionally adjustable spray device of claim 12 wherein:

said two rotatable devices each with a slotted fluid flow passage can be rotated relative to each other.

14. The directionally adjustable spray device of claim 10 wherein:

said control flow modulator has a rotatable device with a fluid flow path mounted eccentrically.

15. The directionally adjustable spray device of claim 10 further comprising:

a conical frustum-like shaped surface adjacent to said output end of said control flow channel.

16. The directionally adjustable spray device of claim 15 wherein:

said conical frustum-like shaped surface adjacent to said output end of said control flow channel is a continuous curved surface.

17. The directionally adjustable spray device of claim 15 wherein:

said conical frustum-like shaped surface adjacent to said output end of said control flow channel is a continuous curved surface that also includes an essentially flat section of surface.

18. The directionally adjustable spray device of claim 15 wherein:

said conical frustum-like shaped surface adjacent to said output end of said control flow channel is a continuous surface that includes a flow surface discontinuity.

19. The directionally adjustable spray device of claim 15 wherein:

said conical frustum-like shaped surface adjacent to said output end of said control flow channel is a continuous surface that includes flow surface frets.

* * * * *